United States Patent [19]

Izawa

[11] 4,091,723

[45] May 30, 1978

[54] BINDING APPARATUS FOR PALLETIZED LOADS

[75] Inventor: Teruaki Izawa, Tokyo, Japan

[73] Assignee: Nihon Hoso Kikai K.K., Tokyo, Japan

[21] Appl. No.: 752,527

[22] Filed: Dec. 20, 1976

[51] Int. Cl.[2] ..... B65B 57/10; G05D 15/00

[52] U.S. Cl. ..... 100/4; 100/33 PB

[58] Field of Search ..... 100/4, 8, 25–29, 100/33 PB

[56] References Cited

U.S. PATENT DOCUMENTS

| | | | |
|---|---|---|---|
| 3,152,539 | 10/1964 | Sorensen | 100/8 |
| 3,279,354 | 10/1966 | Dickens et al. | 100/26 |
| 3,949,662 | 4/1976 | Woomer | 100/4 |
| 4,005,647 | 2/1977 | Goodley et al. | 100/4 |

*Primary Examiner*—Leonard D. Christian

*Attorney, Agent, or Firm*—Oblon, Fisher, Spivak, McClelland & Maier

[57] ABSTRACT

A binding apparatus for tying horizontally around palletized loads is disclosed. The binding apparatus comprises a tie machine which is mounted on a base horizontally moveable on the base so as to advance or retract the tie machine depending upon dimensions of the palletized loads to be tied. The base is vertically adjustable depending upon the height of the palletized loads to be tied.

9 Claims, 7 Drawing Figures

BINDING APPARATUS FOR PALLETIZED LOADS

BACKGROUND OF THE INVENTION

1. FIELD OF THE INVENTION

This invention relates generally to a binding apparatus and more particularly to new and useful improvements in a binding apparatus which is designed for tying horizontally around palletized loads.

2. DESCRIPTION OF THE PRIOR ART

It is a common practice in plants or warehouses to transport merchandise or products stacked on a pallet. In this instance, loads stacked vertically in multiple stages on the pallet sometimes tumble or fall down due to vibration which is caused during the running of the loads on a conveyor or when the loads are lifted from the conveyor together with the pallet by a forklift. Conventionally, the falling of the loads is prevented by tying horizontally around the loads which lie on the upper part of stacked loads. This tying operation is conducted either manually or mechanically, however, it is troublesome to tie the loads having different dimensions and vertical height around the upper part thereof which run on the conveyor according to a production or shipping schedule.

SUMMARY OF THE INVENTION

Accordingly, it is an object of the present invention to provide a binding apparatus for automatically tying palletized loads supplied by a conveyor in conformity with an intermittent running of the conveyor.

Another object of the present invention is to provide a binding apparatus for tying palletized loads which is capable of vertical adjustment of the apparatus depending upon the height of the stack to be bound.

Still another object of the present invention is to provide a binding apparatus for tying palletized loads which is capable of horizontal adjustment of the apparatus depending upon the dimensions of the stack to be bound.

Yet another object of the present invention is to provide a binding apparatus for tying palletized loads which enables to the depositing of loads in plants or warehouses or to the shipping of the loads therefrom as they are on a pallet without loosening the stack of the loads, to thereby remarkably increase the efficiency of handling the loads in the plants or warehouses.

Briefly, the foregoing and the other objects, features and advantages are attained in accordance with the present invention by the provision of an automatic tie machine which is mounted on a base horizontally so as to move forwardly and backwardly. The forward and backward movements of the tie machine are exerted by a pneumatic or hydraulic cylinder or a crank driven by an electric motor, which gives linear reciprocating motion to the tie machine. The base is vertically moveable upwardly and downwardly, actuated by a pneumatic or hydraulic cylinder, rack and pinion jack, or chain and sprocket wheel jack.

BRIEF DESCRIPTION OF THE DRAWINGS

Various other objects, features and attendant advantages of the present invention will be more fully appreciated as the same becomes better understood by reference to the following detailed description when considered in connection with the accompanying drawings, wherein like reference numerals designate like or corresponding parts throughout the several views and in which.

DESCRIPTION OF THE PREFERRED EMBODIMENTS

Figure 1:
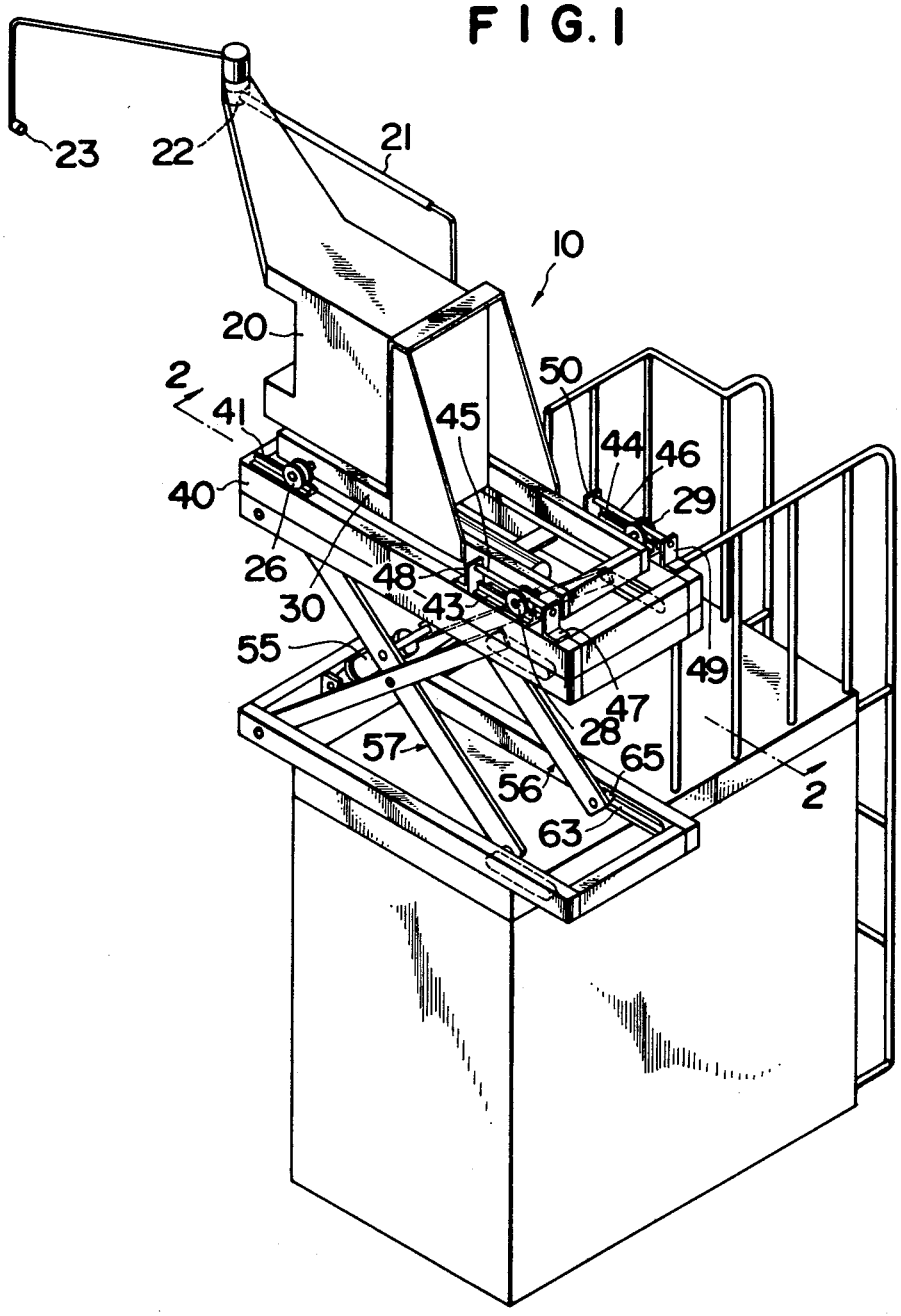
FIG. 1 is a perspective view of an entire assembly of a binding apparatus in accordance with the present invention.
Figure 2:
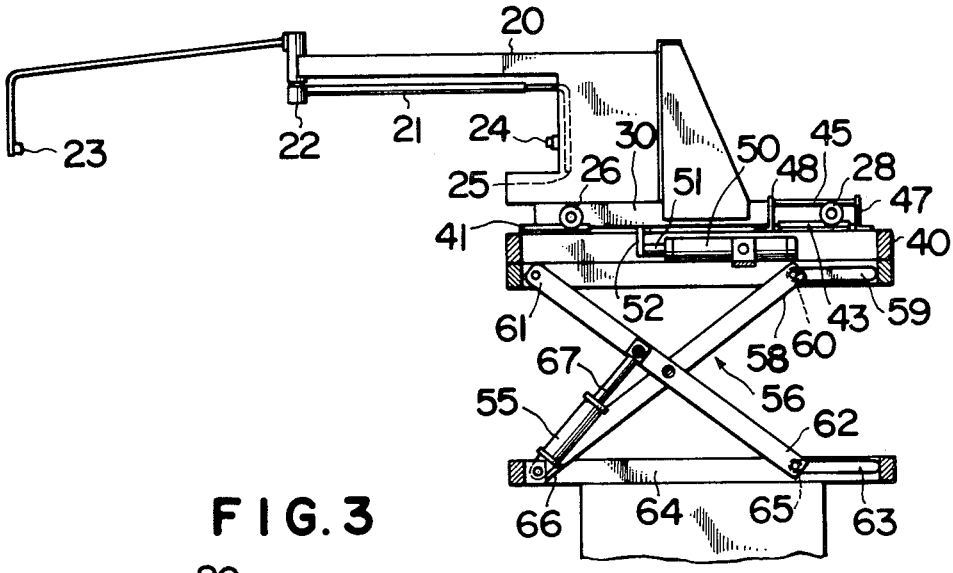
FIG. 2 is a sectional view taken along lines 2—2 of FIG. 1, showing mechanisms for lifting a base vertically, on which a tie machine is mounted, and for advancing or retracting the tie machine horizontally along the base in accordance with an embodiment of the present invention.

Referring now to the drawings, and more particularly to FIGS. 1 and 2, thereof, a binding apparatus generally indicated by the reference numeral 10 includes a tie machine 20, a base 40 on which the tie machine is mounted and motion mechanisms for advancing or retracting the tie machine 20 horizontally along the base, depending upon the dimensions of the loads to be tied and lifting the base 40 vertically, depending upon the height of the loads stacked on a pallet.

The tie machine 20 includes an arm 21, directed downwards, which is rotatable in the radial direction at a pivotal axis 22 for tying horizontally around the palletized loads above a path of a conveyor. A light emitting source 23 and a photoelectric tube 24 are arranged shortly above the terminating end 25 of the arm 21 so as to detect the upper edge of the palletized loads. The arm 21 is actuated to rotate when the upper edge of the palletized loads intersects the line where the light emitting source 23 and the photoelectric tube 24 are disposed. The tie machine 20 is provided with front rollers 26 and 27 and rear rollers 28 and 29 at right and left side surfaces of a framework 30. These rollers are rested upon rails 41, 42, 43 and 44 provided on an upper surface of the base 40 so that the tie machine 20 can be moved forwardly and backwardly on the base 40 by actuation of the motion mechanism. The rear rollers 28 and 29 rested on the rails 43 and 44 are rotatably held by guide bars 45 and 46 which are supported by L-shaped fittings 47, 48, 49 and 50 welded to the upper surface of the base 40. The guide bars 45 and 46 are effective for smoothly advancing or retracting the tie machine 20 on the base 40 and also preventing the rear end of the framework 30 from lifting upwards when the tie machine 20 is advanced. The L-shaped fittings 48 and 50 act as a stopper of the rear rollers 28 and 29.

Figure 3:
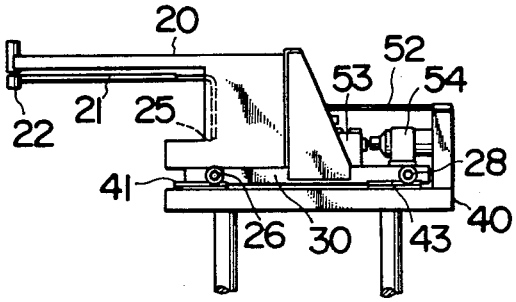
FIG. 3 is a side elevational view of a part of the binding apparatus showing a mechanism for advancing or retracting the tie machine horizontally along the base in accordance with another embodiment of the present invention.
Figure 4:
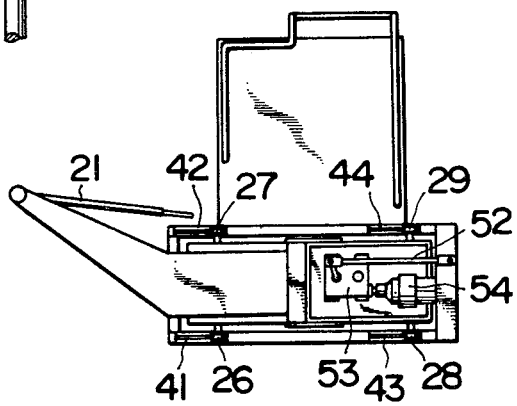
FIG. 4 is a top plan view of the binding apparatus shown in FIG. 3.

As shown in FIG. 2, the motion mechanism for advancing or retracting the tie machine 20 comprises a cylinder 50 having a piston rod 51 which is engaged with a lug 52 extending downwardly from the underside of the tie machine 20. The piston rod 51 may be actuated by pneumatic or hydraulic power or an electric motor. In FIGS. 3 and 4, there is shown the motion mechanism for the tie machine 20 in accordance with another embodiment of the present invention which comprises a link mechanism 52 associated with a reduction gear 53 and driven by a motor 54.

The motion mechanism for lifting the base 40 vertically can be practised in various ways, as shown in FIGS. 1, 2, 5, 6 and 7. In the embodiment shown in FIGS. 1 and 2, the base 40 is lifted by a pneumatic or hydraulic cylinder 55 with the use of links 56 and 57. As shown in FIG. 2, the upper one end 58 of the link 56 is coupled to an elongated slot 59 provided on an inner side face of the base 40 by a pin 60 which is slidable in the slot 59, and the upper another end 61 of the link 56 is pivotally connected to the base 40. In the same manner, the lower one end 62 of the link 56 is coupled to an elongated slot 63 provided on an inner side face of a framework 64 by a pin 65 which is slidable in the slot 63, and the lower another end 66 of the link 56 is pivotally connected to the framework 64. A piston rod 67 of the cylinder 55 is connected to the link 56, and the link 56 is pushed upwards, sliding the pins 60 and 65 in the slots 59 and 63 in which the upper and lower ends 58 and 62 of the link 56 are coupled when the cylinder 55 is actuated. The link 57 is connected to the base 40 and the framework 64 in the same manner as the link 56.

Figure 5:
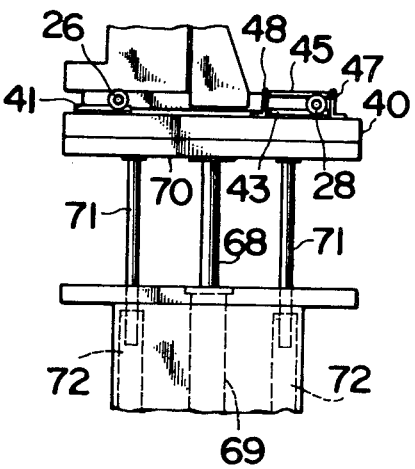
FIG. 5 is a side elevational view of a part of the binding apparatus showing a mechanism for lifting the base vertically in accordance with another embodiment of the present invention.
Figure 6:
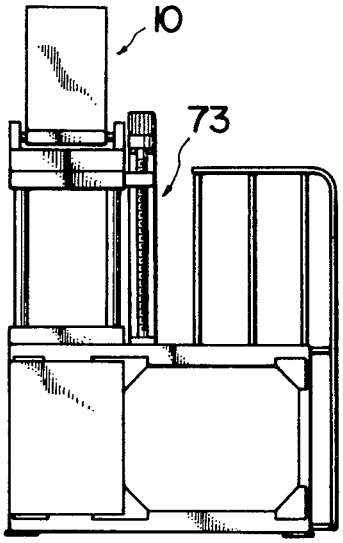
FIG. 6 is a rear side view of the entire assembly of the binding apparatus showing a mechanism for lifting the base vertically in accordance with another embodiment of the present invention.
Figure 7:
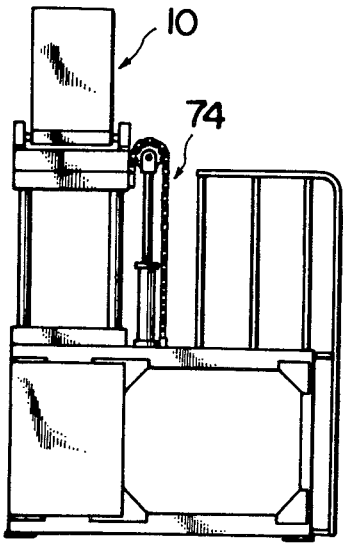
FIG. 7 is a rear side view of the entire assembly of the binding apparatus showing a mechanism for lifting the base vertically in accordance with another embodiment of the present invention.

In the embodiment shown in FIG. 5, a piston rod 68 of pneumatic or hydraulic cylinder 69 is directly connected to the underside 70 of the base 40. The numeral 71 is a guide bar and the numeral 72 is a thrust bearing. The embodiment shown in FIG. 6 uses a rack and pinion jack 73 for lifting the base 40, while the embodiment shown in FIG. 7 uses a chain and sprocket wheel jack 74 for lifting the base 40.

Obviously, many modifications and variations of the present invention are possible in the light of the above teachings. It is therefore to be understood that within the scope of the appended claims, the invention may be practiced otherwise than as specifically described.

What is claimed as new and desired to be secured by letters patent of the United States is:

1. A binding apparatus for tying horizontally around palletized loads comprising:

a tie machine having an arm directed downwards and being rotatable in a radial direction about a pivotal axis above a path of said palletized loads;

a framework support for said tie machine having right and left side surfaces on which front and rear rollers are disposed;

a base having front and rear rails on an upper surface thereof on which said front and rear rollers of said framework supporting said tie machine are rested so as to permit the advancement and retraction of said framework and said tie machine supported thereon on said rails;

L-shaped fittings secured to said upper surface of said base;

said rear rails including guide bars supported by said L-shaped fittings and disposed above said rear rails and extending in parallel relation therewith, to thereby hold said rear rollers of said framework supporting said tie machine between said rear rails and said guide bars;

means for exerting linear reciprocating motion to said framework and said tie machine supported thereon so as to permit said advancement and retraction thereof horizontally on said base; and means for exerting vertical motion to said base so as to raise or lower said base.

2. A binding apparatus for tying horizontally around palletized loads as set forth in claim 1, further comprising a light emitting source and photoelectric tube for detecting the upper edge of said palletized loads.

3. A binding apparatus for tying horizontally around palletized loads as set forth in claim 1, wherein said means for exerting reciprocating motion to said tie framework and said tie machine supported thereon is one of a pneumatic and a hydraulic cylinder.

4. A binding apparatus for tying horizontally around palletized loads as set forth in claim 1, wherein said means for exerting reciprocating motion to said framework and said tie machine supported thereon comprises a cylinder and an electric motor, said cylinder being actuated by said electric motor.

5. A binding apparatus for tying horizontally around palletized loads as set forth in claim 1, wherein said means for exerting reciprocating motion to said framework and said tie machine supported thereon comprises a link, an electric motor for driving said link and a reduction gear connected between said link and said electric motor.

6. A binding apparatus for tying horizontally around palletized loads as set forth in claim 1, wherein said means for exerting vertical motion to said base comprises a link and one of a pneumatic and a hydraulic cylinder for driving said link.

7. A binding apparatus for tying horizontally around palletized loads as set forth in claim 1, wherein said means for exerting vertical motion to said base is one of a pneumatic or hydraulic cylinder, a piston rod of which is directly connected to the underside of said base.

8. A binding apparatus for tying horizontally around palletized loads as set forth in claim 1, wherein said means for exerting vertical motion to said base is a rack and pinion jack.

9. A binding apparatus for tying horizontally around palletized loads as set forth in claim 1, wherein said means for exerting vertical motion to said base is a chain and sprocket wheel.

* * * * *